US010568411B2

(12) United States Patent
Dengler et al.

(10) Patent No.: US 10,568,411 B2
(45) **Date of Patent: *Feb. 25, 2020**

(54) BRUSH HEAD ARRANGEMENTS

(71) Applicant: KONINKLIJKE PHILIPS N.V., Eindhoven (NL)

(72) Inventors: Evan Dak Wah Dengler, Seattle, WA (US); Gregory Russ Goddard, Kenmore, WA (US); Eric G. Halsne, Kenmore, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 446 days.

This patent is subject to a terminal disclaimer.

(21) Appl. No.: 15/127,926

(22) PCT Filed: Mar. 24, 2015

(86) PCT No.: PCT/IB2015/052145

§ 371 (c)(1),
(2) Date: Sep. 21, 2016

(87) PCT Pub. No.: WO2015/145350

PCT Pub. Date: Oct. 1, 2015

(65) Prior Publication Data

US 2017/0086572 A1 Mar. 30, 2017

Related U.S. Application Data

(60) Provisional application No. 62/025,039, filed on Jul. 16, 2014, provisional application No. 62/008,762,
(Continued)

(51) Int. Cl.
*A46B 3/06* (2006.01)
*A46B 3/20* (2006.01)
(Continued)

(52) U.S. Cl.
CPC ..... *A46B 3/06* (2013.01); *A46B 3/00* (2013.01); *A46B 3/04* (2013.01); *A46B 3/20* (2013.01);
(Continued)

(58) Field of Classification Search
CPC .... A46B 3/00; A46B 3/04; A46B 3/06; A46B 3/20; A46B 7/00; A46B 7/06; A46B 9/00; A46B 9/04; A46B 9/08; A46B 9/12
(Continued)

(56) References Cited

U.S. PATENT DOCUMENTS 3,082,457 A 3/1963 Lucibello et al.
3,378,870 A 4/1968 Matsunaga
(Continued)

FOREIGN PATENT DOCUMENTS

CN 1038927 A 1/1990
DE 459657 * 5/1928
(Continued)

OTHER PUBLICATIONS

Partial machine translation of DE 1,457,055, Sep. 24, 1970.*

*Primary Examiner* — Mark Spisich

(57) ABSTRACT

A brush head (100), including: an elastomeric matrix (30) including a first surface (32); a plurality of retention rings (50) disposed in the elastomeric matrix, each of which includes a first end (51), a second end (53) positioned closer to the first surface of the elastomeric matrix than the first end, an interior wall (55) forming an interior space (59) with a central longitudinal axis (111), and an exterior wall (57). At least one of the interior wall and the exterior wall of at least a first retention ring of the plurality of retention rings (50) includes a taper (61, 67, 73, 63, 69, 71). A plurality of bristle tufts (21), each of which comprises a plurality of bristle strands, having a proximal end (23) and a free end
(Continued)

(25), is retained at its proximal end within the interior space of one of the plurality of retention rings.

18 Claims, 6 Drawing Sheets

Related U.S. Application Data filed on Jun. 6, 2014, provisional application No. 61/974,760, filed on Apr. 3, 2014, provisional application No. 61/970,076, filed on Mar. 25, 2014, provisional application No. 61/970,011, filed on Mar. 25, 2014, provisional application No. 61/970,169, filed on Mar. 25, 2014, provisional application No. 61/970,157, filed on Mar. 25, 2014.

(51) Int. Cl.

| | |
|---|---|
| ***A46D 3/00*** | (2006.01) |
| ***A46B 9/04*** | (2006.01) |
| ***A46B 3/00*** | (2006.01) |
| ***A46B 3/04*** | (2006.01) |
| ***A46B 5/00*** | (2006.01) |
| ***A46B 9/00*** | (2006.01) |

(52) U.S. Cl.
CPC ..... *A46B 5/0029* (2013.01); *A46B 9/00* (2013.01); *A46B 9/04* (2013.01); *A46D 3/00* (2013.01); *A46B 2200/1066* (2013.01)

(58) Field of Classification Search
USPC ..... 15/167.1, 190, 191.1, 192, 193, 201
See application file for complete search history.

(56) References Cited

U.S. PATENT DOCUMENTS

| | | | |
|---|---|---|---|
| 5,802,656 | A | 9/1998 | Dawson et al. |
| 8,069,524 | B2 | 12/2011 | Kraemer |
| 2006/0272113 | A1 | 12/2006 | Cato et al. |

FOREIGN PATENT DOCUMENTS

| | | | | |
|---|---|---|---|---|
| DE | 1457055 | | * | 9/1970 |
| DE | 10303548 | | * | 8/2004 |
| JP | H0490709 | A | | 3/1992 |
| JP | 2002345560 | A | | 12/2002 |
| JP | 2003102552 | A | | 4/2003 |
| WO | 9812948 | A1 | | 4/1998 |
| WO | 9843514 | A1 | | 10/1998 |
| WO | 2004080238 | A1 | | 9/2004 |
| WO | 2005013762 | A1 | | 2/2005 |
| WO | 2006012956 | A2 | | 2/2006 |

* cited by examiner

BRUSH HEAD ARRANGEMENTS

CROSS-REFERENCE TO PRIOR APPLICATIONS

This application is the U.S. National Phase application under 35 U.S.C. § 371 of International Application No. PCT/IB2015/052145, filed on Mar. 24, 2015, which claims the benefit of U.S. Provisional Patent Application Number's 2/025,039, filed on Jul. 16, 2014, 62/008,762, filed on Jun. 6, 2014, 61/974,760, filed on Apr. 3, 2014, 61/970,076, filed on Mar. 25, 2014, 61/970,011, filed on Mar. 25, 2014, 61/970,169, filed on Mar. 25, 2014, 61/970,157, filed on Mar.25, 2014. These applications are hereby incorporated by reference herein.

FIELD OF THE INVENTION

The present disclosure is directed generally to an improved brush head, and more particularly, to the arrangement, structure, securement, and resulting function of bristle tufts in a brush head.

BACKGROUND

Brush heads used with manual and power brushes, which have bristle tufts contained within retention or support rings are known. The retention rings serve to secure respective bristle tufts within the brush head. Each bristle tuft is inserted into the hollow interior of a different retention ring, which are then secured to the tooth brush head. Notably, conventional retention rings are constructed with straight walls. In some instances, the retention rings are not firmly secured to the brush head, such that bristles are not at an optimal angle for brushing, or the ring and/or bristle tufts or bristle strands are loose within the brush head. As such, a related problem with such conventional retention rings is that under the dynamic conditions of motion induced by the power brush operation, for example, the retention rings and/or bristle tufts or bristle strands tend to separate from the brush head.

Accordingly, there is a need in the art for a better retention ring and improved securement of retention rings and bristle tufts, especially for use with power brushes.

SUMMARY OF THE INVENTION

The present disclosure is directed to an inventive arrangement, structure, securement, and resulting function of bristle tufts in a brush head. Various embodiments and implementations herein are directed to a brush head formed from an elastomeric matrix that can include a variety of retention rings of differing sizes and shapes disposed therein, wherein each retention ring can include a bristle tuft retained at their respective proximal ends therein and extending from a first surface thereof, and wherein at least one of the interior wall and the exterior wall of at least a first retention ring of the plurality of retention rings includes at least one taper. Further embodiments can include at least one bristle tuft being retained at a position within the elastomeric matrix, which further comprises an area void of elastomeric matrix material adjacent to the proximal end of the first bristle tuft and within which the proximal end of the first bristle tuft is configured to translate into and out of during use.

Using the various embodiments and implementations herein, securement of the retention rings within the brush head and securement of the bristle tufts within the retention rings can be substantially improved by providing variations of tapered retention rings. For example, a retention ring with a tapered exterior wall can have an exterior wall that slants inwards from the proximal end of the bristle tuft toward the retention ring central axis. This creates a wedge like effect on the elastomeric matrix underneath the ring toward the first surface of the elastomeric matrix, and also results in a larger elastomeric matrix-retention ring surface area contact than can be achieved by straight retention ring exterior walls. The main pull out mechanism of the tuft typically occurs with delamination in the elastomeric matrix-retention ring bond, so increasing the surface area can be critical to improved retention. Varying partial or complete interior tapers or combined interior and exterior tapers, and encompassing the proximal end of a bristle tuft (preferably encompassing the retention ring, if any, as well) in a proximal cap within the elastomeric matrix provide similar and additional benefits.

The improved brush head disclosed and described herein can be used with any manual or power brush device. One example of a power brush device that the improved brush head can be used with Sonicare® device available from Koninklijke Philips Electronics N.V. This oral care device is based upon an actuator with a reciprocating brush head including bristles to provide an effective cleaning of a user's teeth.

Generally in one aspect, a brush head is provided and includes, but is not limited to an elastomeric matrix; a plurality of retention rings disposed in the elastomeric matrix, each of which includes a first end, a second end positioned closer to the first surface of the elastomeric matrix than the first end, an interior wall forming an interior space with a central longitudinal axis, and an exterior wall, where at least one of the interior wall and the exterior wall of at least a first retention ring of the plurality of retention rings includes a taper; and a plurality of bristle tufts, each of which includes a plurality of bristle strands, having a proximal end and a free end, and is retained at its proximal end within the interior space of one of the plurality of retention rings In accordance with an embodiment, the interior wall of at least the first retention ring includes a taper extending from the first end to the second end in a direction toward the central longitudinal axis.

In accordance with an embodiment, the interior wall of at least the first retention ring includes a taper extending from the first end to the second end in a direction away the central longitudinal axis.

In accordance with an embodiment, a proximal portion of the at least first retention ring includes an interior wall with a taper extending from the first end to the distal portion in a direction toward the central longitudinal axis.

In accordance with an embodiment, the exterior wall of at least the first retention ring includes a taper extending from the first end to the second end in a direction toward the central longitudinal axis.

In accordance with an embodiment, the exterior wall of at least the first retention ring includes a taper extending from the first end to the second end in a direction away the central longitudinal axis.

In accordance with an embodiment, a proximal portion of the at least first retention ring includes an exterior wall with a taper extending from the first end to the distal portion in a direction toward the central longitudinal axis.

In accordance with an embodiment, each of the interior wall and the exterior wall of at least the first retention ring includes a taper extending from the first end to the second end in a direction toward the central longitudinal axis.

In accordance with an embodiment, each of the interior wall and the exterior wall of at least the first retention ring includes a taper extending from the first end to the second end in a direction away the central longitudinal axis.

In accordance with an embodiment, at least one of the interior wall and the exterior wall of at least a first retention ring is non-circular in shape, the non-circular shape is selected from the group consisting of triangular, square, pentagonal, hexagonal, heptagonal, octagonal, nonagonal, and decagonal.

In accordance with an embodiment, the plurality of bristle tufts positioned and retained within the plurality of retention rings further includes a head portion at the proximal end of the first bristle tuft, said head portion being positioned adjacent to the first end of the first retention ring and having an area larger than the area of a plane of the interior space surrounded and created by the first end of the first retention ring.

In accordance with an embodiment, each of the plurality of bristle tufts positioned and retained within the plurality of retention rings further comprises a head portion at the proximal end of the bristle tuft, the head portion being positioned adjacent to the first end of one of the plurality of retention rings and having an area larger than the area of a plane of the interior space surrounded and created by the first end of the one of the plurality of retention rings.

In accordance with an embodiment, each of the plurality of bristle tufts positioned and retained within the plurality of retention rings further includes a head portion at the proximal end of the bristle tuft, said head portion being positioned within the interior space of one of the plurality of retention rings and having an area larger than the area of a plane within the interior space of the one of the plurality of retention rings.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of an improved brush head for dental cleaning. More generally, Applicants have recognized and appreciated that it would be beneficial to provide a brush head that includes particular components with varied and unique geometries and unique combinations of materials and structures for the purposes of improved retention of bristle tufts within retention rings, improved securement of retention rings within the brush head, and for improved and more complete oral cleaning.

In one arrangement, securement of the retention rings within the brush head and securement of the bristle tufts within the retention rings can be substantially improved by providing variations of tapered retention rings. In another arrangement incorporating layers in the elastomeric matrix with different elastic modulus values and providing other configurations of the matrix to allow for varied purposeful mobility of bristle tufts/flexibility of the elastomeric matrix can lead to improved and more complete oral cleaning. In an additional arrangement, an embodiment contemplates arrangements of individual retention rings in an elastomeric matrix with any combination of interior wall and exterior wall shape combinations including a variety of non-circular shapes (i.e., shapes with angles) including, but not limited to, triangular, square, pentagonal, hexagonal, heptagonal, octagonal, nonagonal, and decagonal etc. that are tapered on at least one of the interior wall and/or exterior wall of the retaining ring.

In view of the foregoing, various embodiments and implementations are directed to an apparatus in which a brush head can include a variety of retention rings of differing sizes and shapes disposed therein, wherein each retention ring can include a bristle tuft retained at their respective proximal ends therein and extending from a first surface thereof, and wherein at least one of the interior wall and the exterior wall of at least a first retention ring of the plurality of retention rings includes a taper. Further embodiments and implementations are directed to at least one bristle tuft being retained within a retention ring, which further includes an area void of elastomeric matrix material adjacent to the proximal end of the bristle tuft and within which the proximal end of the bristle tuft is configured to translate into and out of during use.

Figure 1A:
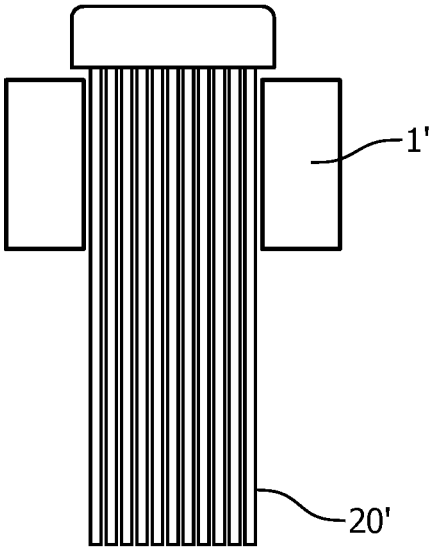
(Prior Art) FIG. 1A
FIG. 1A is a side view schematic representation of a retention ring with a bristle tuft retained therein in accordance with the prior art.

Referring to FIG. 1A, an example of the prior art, a side view schematic representation of a retention ring 1' with a bristle tuft 20' retained therein is provided. As shown, in the prior art, retention ring 1' has a straight non-tapered interior wall and a straight non-tapered exterior wall.

Figure 1B:
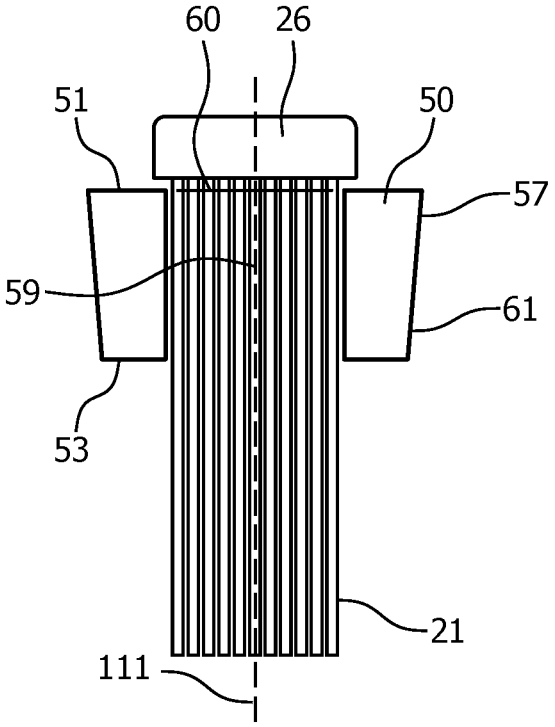
FIG. 1B is a side view schematic representation of a retention ring of the present invention with a bristle tuft retained therein and including an exterior wall with a taper in accordance with an embodiment.
Figure 1C:
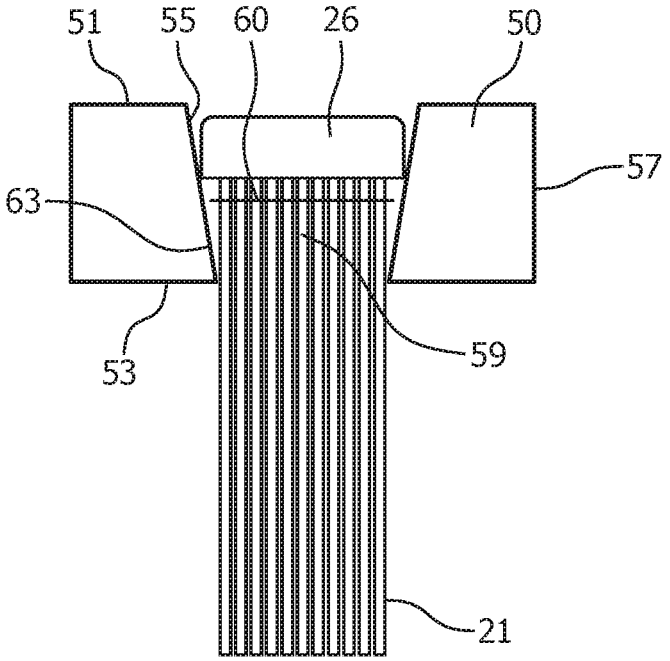
FIG. 1C is a side view schematic representation of a retention ring with a bristle tuft retained therein and including an interior wall with a taper in accordance with an embodiment.
Figure 1D:
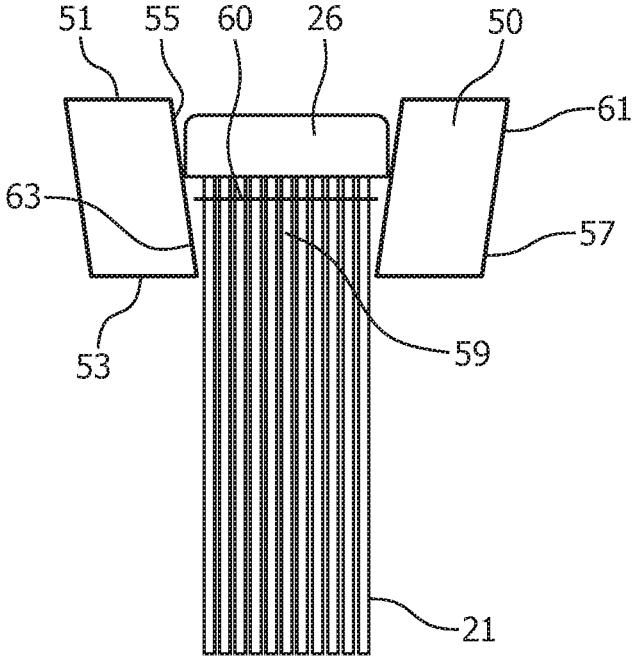
FIG. 1D is a side view schematic representation of a retention ring with a bristle tuft retained therein and including an exterior wall and interior wall, each of which including a taper, in accordance with an embodiment.

In embodiments of the present invention, each of FIGS. 1B-1D show a side view schematic representation of a retention ring 50 with a bristle tuft 21 including a head portion 26 retained therein, where at least one of the interior wall 55 and the exterior wall 57 includes a taper extending from the first end 51 to the second end 53 of the retention ring 50 in a direction toward the retention ring's central longitudinal axis 111. More specifically, FIG. 1B shows a retention ring 50 with an exterior wall taper 61. FIG. 1B also shows a head portion 26, which is positioned outside the interior space 59 and has an area larger than the area of a plane 60 within the interior space of the retention ring 50. FIG. 1C shows a retention ring 50 with an interior wall taper 63, and FIG. 1D shows a retention ring 50 with an exterior wall taper 61 and an interior wall taper 63. FIGS. 1C and 1D also show a head portion 26 at the proximal end of the bristle tuft 21, where the head portion 26 is positioned within the interior space 59 of the retention ring 50 and has an area larger than the area of a plane 60 within the interior space of the first retention ring 50.

Figure 2A:
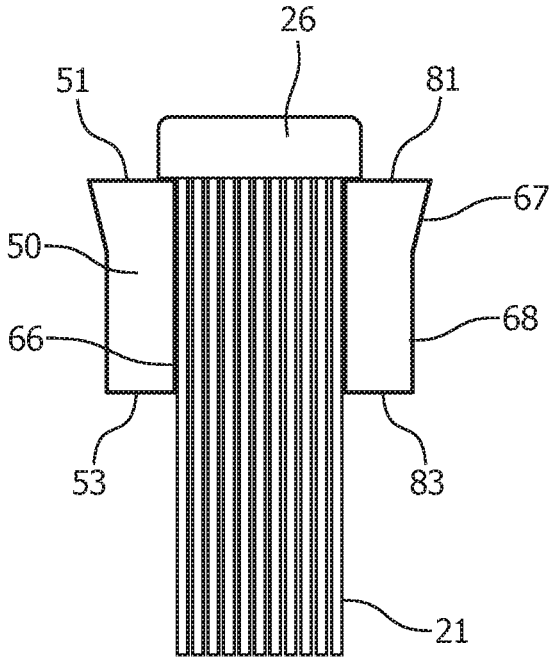
FIG. 2A is a side view schematic representation of a retention ring with a bristle tuft retained therein and including an exterior wall, a proximal portion of which includes a taper in accordance with an embodiment.
Figure 2B:
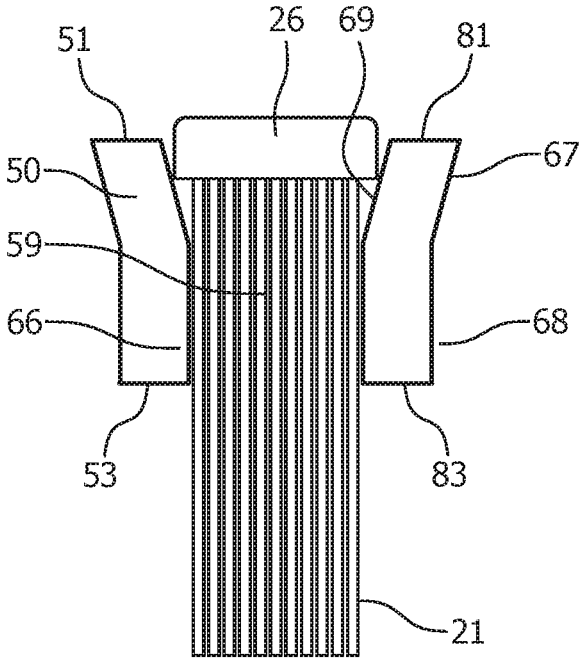
FIG. 2B is a side view schematic representation of a retention ring with a bristle tuft retained therein and including an exterior wall and interior wall, a proximal portion of each includes a taper in accordance with an embodiment.

Referring to FIGS. 2A-2B, in additional embodiments, side view schematic representations of a retention ring 50 with a bristle tuft 21 including a head portion 26 retained therein are shown, where at least a proximal portion 81 of one of the interior wall 55 or the exterior wall 57 includes a taper extending from the first end 51 to a distal portion 83 (with straight interior wall portion 66 and straight exterior wall portion 68) of the retention ring 50 in a direction toward the retention ring's central longitudinal axis are shown. As compared to the retention rings described with respect to FIGS. 1B-1D, the tapers shown in FIGS. 2A-2B are included in only a portion of the retention ring. More specifically, FIG. 2A shows an exterior wall taper 67 extending from the first end 51 at the proximal portion 81 of the retention ring 50 to the distal portion 83 in the direction toward the retention ring's central longitudinal axis. The exterior wall taper 67 has a geometry which changes the cross-sectional area and profile depending on height of the collar. With this "Y-shape" configuration, the thickness of the collar can get thicker closer to the melted portions of the bristle tufts. This increased thickness can provide more rigidity to the collar and can more widely distribute the load to the surrounding elastomeric matrix in which the retention ring sits. Additionally, with respect to FIG. 2A, keeping the interior diameter constant can ensure that the collar is an alignment feature for the bristle tufts. The lower flat parallel walls 66 and 68 of the distal portion 83 can serve a purpose in manufacturing to secure and align the bristle tufts during future injection molding steps for the surrounding material. FIG. 2B shows a combination of an exterior wall taper 67 and an interior wall taper 69 extending from the first end 51 at the proximal portion 81 of the retention ring 50 to the distal portion 83 in the direction toward the retention ring's central longitudinal axis. These embodiments contemplate that the interior wall or the exterior wall of the proximal portion 81 or the distal portion 83, or a combination of the two, can include a taper in either direction (i.e., toward or away from the retention ring's central longitudinal axis). Collars where both the interior wall and exterior wall dimensions change with respect to height (parallel dimension to bristles) can have the shape either stay consistent or change (bottom cross sectional shape is square and top cross sectional shape is circle. Twisting (screw like) shapes are also possible and could have tuft retention benefits.

Figure 3A:
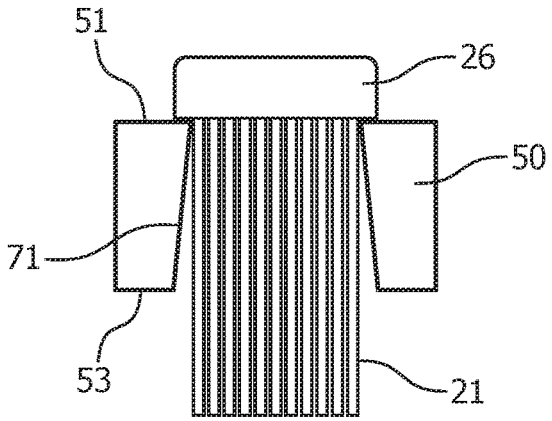
FIG. 3A is a side view schematic representation of a retention ring with a bristle tuft retained therein and including an interior wall with a taper in accordance with an embodiment.
Figure 3B:
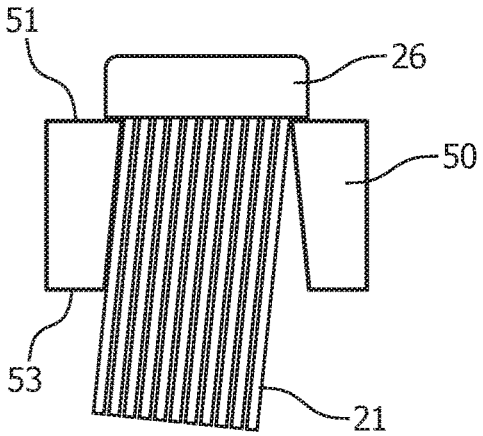
FIG. 3B is a side view schematic representation of a retention ring with a bristle tuft retained therein and including an interior wall with a taper in accordance with an embodiment.
Figure 3C:
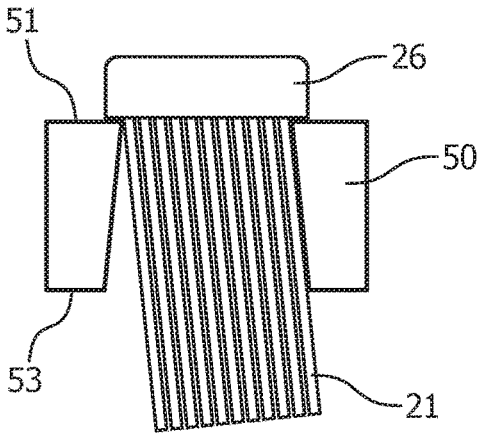
FIG. 3C is a side view schematic representation of a retention ring with a bristle tuft retained therein and including an interior wall with a taper in accordance with an embodiment.
Figure 3D:
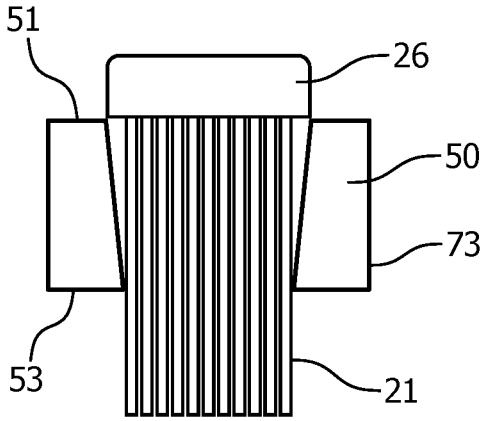
FIG. 3D is a side view schematic representation of a retention ring with a bristle tuft retained therein and including an exterior wall with a taper in accordance with an embodiment.
Figure 3E:
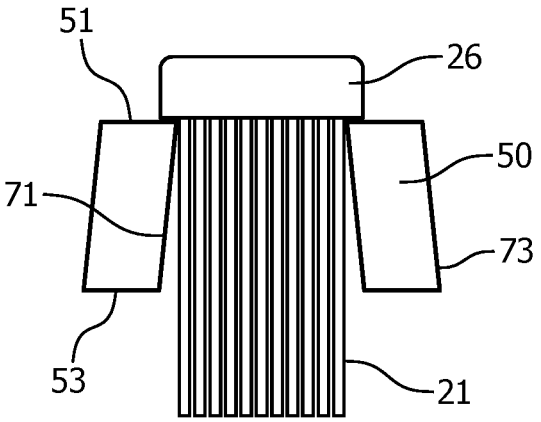
FIG. 3E is a side view schematic representation of a retention ring with a bristle tuft retained therein and including an interior wall with a taper and an exterior wall with a taper in accordance with an embodiment.

Referring to FIGS. 3A-3E, in additional embodiments, side view schematic representations of a retention ring 50 with a bristle tuft 21 including a head portion 26 retained therein are shown, where at least one of the interior wall and the exterior wall includes a taper extending from the first end 51 to the second end 53 of the retention ring 50 in a direction away the retention ring's central longitudinal axis (not shown). More specifically, FIG. 3A shows a retention ring 50 with an interior wall taper 71 in a direction away the retention ring's central longitudinal axis. FIGS. 3B and 3C show the potential span/area of mobility of bristle tuft 21 for higher bristle tip/free end mobility based on the configuration shown in and described with respect to FIG. 3A. FIG. 3D shows a retention ring 50 with an exterior wall taper 73 in a direction away the retention ring's central longitudinal axis. FIG. 3E shows a retention ring with both an interior wall taper 71 and an exterior wall taper 73 in a direction away the retention ring's central longitudinal axis.

According to an embodiment, the various tapered geometries (as shown and described herein with respect to FIGS. 1B-1D, 2A-2B, and 3A-3E) assist with the securement of the bristle tufts within the retention rings and of the retention rings within the elastomeric matrix. An embodiment contemplates all different variations of tapers of the interior wall 55 and/or the exterior wall 57, from the first end 51 or the second end 53, and toward or away from the retention ring's central longitudinal axis.

Figure 4:
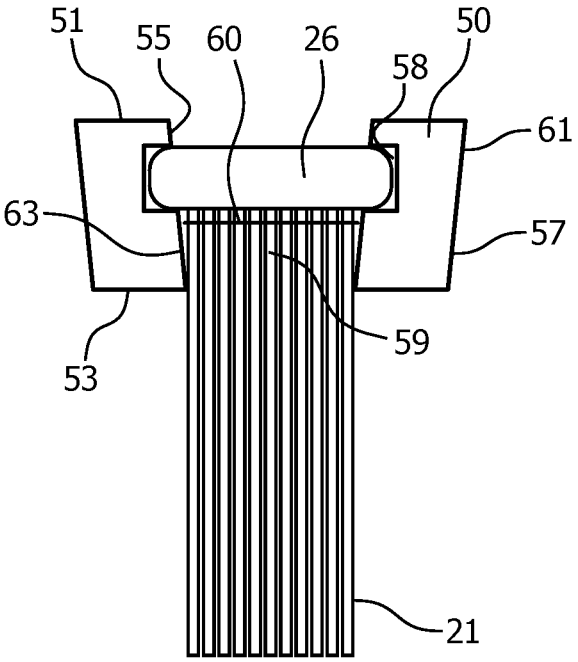
FIG. 4 is a side view schematic representation of a retention ring with a tuft retained therein and including an exterior wall and interior wall, each of which includes a taper, the interior wall further including a groove around the circumference in accordance with an embodiment.

Referring to FIG. 4, in an additional embodiment, a side view schematic representation of a retention ring 50 with a bristle tuft 21 retained therein and including an exterior wall 57 and interior wall 55, each of which includes a taper (61 and 63, respectively) is shown. The interior wall 55 further includes a circumferential groove 58 in accordance with an embodiment. A head 26 of a bristle tuft 21 can sit within groove 58, which can provide further securement of the bristle tuft 21 within the retention ring 50. Stated differently, the groove 58 further helps to prevent unwanted vertical movement of the bristle tuft 21 by "locking in" the bristle tuft 21 within the retention ring 50.

Figure 5A:
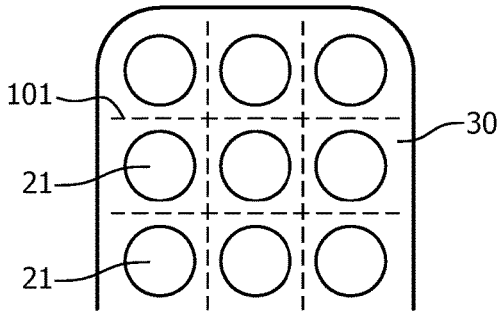
FIG. 5A is a top view schematic representation of an elastomeric matrix showing a density of similarly shaped and sized bristle tufts in accordance with an embodiment.
Figure 5B:
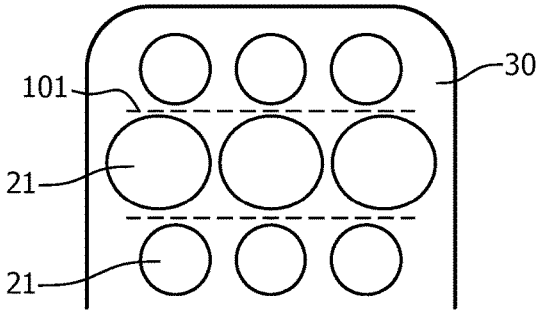
FIG. 5B is a top view schematic representation of an elastomeric matrix showing a density of similarly shaped and differently sized bristle tufts in accordance with an embodiment.
Figure 5C:
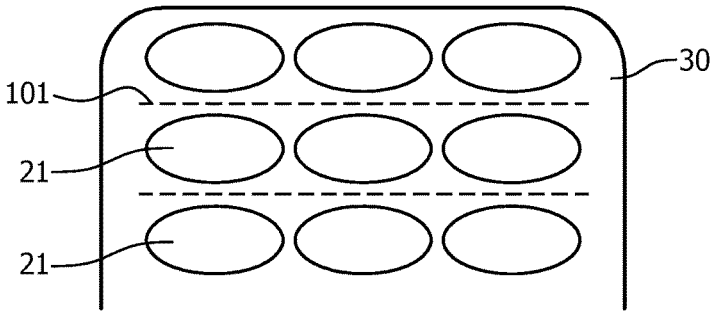
FIG. 5C is a top view schematic representation of an elastomeric matrix showing a density of similarly shaped and sized bristle tufts in accordance with an embodiment.

According to an embodiment, the number, placement and density of the bristle tufts 21 can vary. Applicants have recognized and appreciated that bristle tuft packing placement can restrict or enhance movement of a flexible elastomeric matrix, which can be beneficial to a brush head's function (especially in powered brush devices); and varying bristle tuft shapes can be used to customize movement of flexible elastomeric matrices. Further, both limiting and enhancing certain movements can be critical to brush head function in powered toothbrushes. The more densely packed the bristle tufts 21, the stiffer (higher elastic modulus) the elastomeric matrix. This additional stiffness is partially a function of the more tightly packed retention rings, which are preferably formed of a material that is stiffer than the elastomeric matrix material. Referring to FIG. 5A, in one embodiment, a top view schematic representation of an elastomeric matrix 30 showing a density of similarly shaped and sized bristle tufts 21, with longitudinal "bending" joints 101 positioned in between each bristle tuft in the elastomeric matrix 30, is provided. FIG. 5B, in an alternative embodiment, shows a top view schematic representation of an elastomeric matrix 30 showing a density of similarly shaped and differently sized bristle tufts 21 (larger followed by smaller followed by larger, along several parallel horizontal planes, as viewed on the page) in accordance with an embodiment. FIG. 5C, in an alternative embodiment, shows a top view schematic representation of an elastomeric matrix 30 showing a density of similarly shaped (generally oval/elliptically-shaped) and sized bristle tufts 21 (relatively larger than the bristle tufts shown in FIG. 5A) in accordance with an embodiment. The bending joints 101 in FIGS. 5B and 5C extend along the horizontal direction (as one views these Figures) only, in part, as a function of the relatively larger and/or oval-shaped bristle tufts 21. Stated differently, FIGS. 5B and 5C show embodiments which limit the flexibility of the elastomeric matrix in certain directions (in these Figures, greater relative flexibility along a horizontal axis).

In accordance with an embodiment, due to a preferred higher material stiffness (relative higher elastic modulus) of the retention ring compared to the surrounding elastomeric matrix, the placement of bristle tufts within the retention rings in the elastomeric matrix can cause specialized behavior in dynamic systems. The retention ring shape and bristle tuft packing placement can fine tune this specialized behavior, as described and detailed herein. This "fine tuning" can be performed to limit or enhance flexibility to in a desired axis or dimension. For example, the density and/or particular placement of bristle tufts, size of bristle tufts, and shape of bristle tufts can be optimized to create joints and to increase or decrease elastomeric matrix flexibility (and thus, restrict or enhance movement of the elastomeric matrix as may be desired). Relative elastomeric matrix flexibility can be beneficial by improving the bristle field's ability to conform to various oral geometries. A predetermined minimum platen stiffness is essential for structural integrity as well as limiting the brush head's overall deflection. This predetermined minimum platen stiffness can be essential to ensure the moment of inertia stays within optimal levels for drive train performance.

Figure 6:
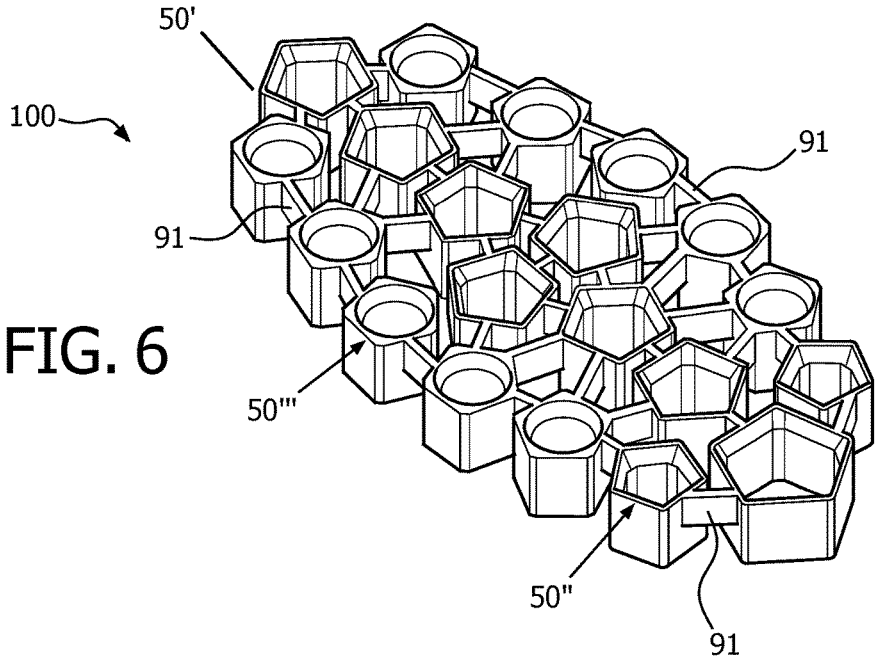
FIG. 6 a top perspective view schematic representation showing webbing links connecting retention rings of different sizes and shapes in accordance with an embodiment.

According to an embodiment, at least some of the plurality of retention rings in a brush head assembly 100 can be connected by a webbing or matrix of webbing links as shown in FIG. 6. In one embodiment, a top perspective view schematic representation of webbing links 91 connecting a certain example arrangement of retention rings-50' -50''' -is provided. More specifically, this embodiment shows links 91 connecting each of the retention rings. The webbing links 91 can serve to further stiffen an elastomeric matrix 30 (in which the retention rings and webbing, or a part thereof, can be seated) and to improve retention ring and bristle tuft retention within the elastomeric matrix 30. While the arrangement shown in FIG. 6 shows all of the retention rings connected by webbing, it can be appreciated that as few as a total of two retention rings can be connected by webbing links. The webbing links and retention rings can be formed of a material different from the elastomeric matrix, and preferably is a material that is stiffer (material that includes a higher elastic modulus value) than the elastomeric matrix 30.

Retention rings 50 can comprise a wide variety of different shapes and sizes. The retention rings comprise an exterior wall 57 and an interior wall 55, which defines an interior space 59. According to an embodiment, the geometric shape of exterior wall 57 can be the same or can differ from the geometric shape of interior wall 55. For example, as shown in FIG. 6, the geometric shape of the exterior wall 57 of retention ring 50''' is pentagonal, while the geometric shape of its interior wall 55 is circular; and the geometric shape of the exterior wall 57 of retention ring 50' is the same (pentagonal) as the geometric shape of its interior wall 55. Such combinations of shapes can be mixed and matched in one brush head assembly 100. An embodiment contemplates all other non-circular shapes (i.e., shapes with angles) for the interior wall shape and/or the exterior wall shape of any retention ring (including, but not limited to, triangular, square, pentagonal, hexagonal, heptagonal, octagonal, nonagonal, and decagonal etc.). An embodiment also contemplates arrangements of individual retention rings in an elastomeric matrix 30 with any combination of interior wall 55 and exterior wall 57 shape combinations (e.g., circular and non-circular; or two different non-circular shapes such as pentagonal and triangular, respectively), and a variety of any combination of interior space 59 area sizes. An embodiment further contemplates the addition of the interior wall tapers and/or the exterior wall tapers, as described herein, to each of the described size and shape combinations of the retention rings 50.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A brush head, comprising:

an elastomeric matrix comprising a first surface;

a plurality of retention rings disposed in the elastomeric matrix, each of which comprises a first end, a second end positioned closer to the first surface of the elastomeric matrix than the first end, an interior wall forming an interior space with a central longitudinal axis, and an exterior wall, wherein at least one of the interior wall and the exterior wall of at least a first retention ring of the plurality of retention rings comprises a straight taper at the first end which is disposed in the elastomeric matrix, the first end being at least as thick as the second end and further wherein at least one of the interior wall and the exterior wall of at least the first retention ring is non-circular in shape, the non-circular shape is selected from the group consisting of triangular, square, pentagonal, hexagonal, heptagonal, octagonal, nonagonal, and decagonal; and a plurality of bristle tufts, each of which comprises a plurality of bristle strands, having a proximal end and a free end, and is retained at its proximal end within the interior space of one of the plurality of retention rings.

2. The brush head of claim 1, wherein the interior wall of at least the first retention ring comprises a straight taper extending from the first end to the second end in a direction toward the central longitudinal axis.

3. The brush head of claim 1, wherein the interior wall of at least the first retention ring comprises a straight taper extending from the first end to the second end in a direction away the central longitudinal axis.

4. The brush head of claim 1, wherein a proximal portion of at least the first retention ring comprises an interior wall with a straight taper extending from the first end to a distal portion in a direction toward the central longitudinal axis.

5. The brush head of claim 1, wherein the exterior wall of at least the first retention ring comprises a straight taper extending from the first end to the second end in a direction toward the central longitudinal axis.

6. The brush head of claim 1, wherein the exterior wall of at least the first retention ring comprises a straight taper extending from the first end to the second end in a direction away the central longitudinal axis.

7. The brush head of claim 1, wherein a proximal portion of at least the first retention ring comprises an exterior wall with a straight taper extending from the first end to a distal portion in a direction toward the central longitudinal axis.

8. The brush head of claim 1, wherein each of the interior wall and the exterior wall of at least the first retention ring comprises a straight taper extending from the first end to the second end in a direction toward the central longitudinal axis.

9. The brush head of claim 1, wherein each of the interior wall and the exterior wall of at least the first retention ring comprises a straight taper extending from the first end to the second end in a direction away the central longitudinal axis.

10. The brush head of claim 1, wherein each of the plurality of bristle tufts positioned and retained within the plurality of retention rings further comprises a head portion at the proximal end of the bristle tuft, said head portion being positioned adjacent to the first end of one of the plurality of retention rings and having an area larger than the area of a plane of the interior space surrounded and created by the first end of the one of the plurality of retention rings.

11. The brush head of claim 1, wherein each of the plurality of bristle tufts positioned and retained within the plurality of retention rings further comprises a head portion at the proximal end of the bristle tuft, said head portion being positioned within the interior space of one of the plurality of retention rings and having an area larger than the area of a plane within the interior space of the one of the plurality of retention rings.

12. A brush head, comprising:

an elastomeric matrix comprising a first surface;

a plurality of retention rings disposed in the elastomeric matrix, each of which comprises a first end, a second end positioned closer to the first surface of the elastomeric matrix than the first end, an interior wall forming an interior space with a central longitudinal axis, and an exterior wall, wherein at least one of the interior wall and the exterior wall of at least a first retention ring of the plurality of retention rings comprises a straight continuous taper between the first end and the second end and further wherein at least one of the interior wall and the exterior wall of at least the first retention ring is non-circular in shape, the non-circular shape is selected from the group consisting of triangular, square, pentagonal, hexagonal, heptagonal, octagonal, nonagonal, and decagonal; and a plurality of bristle tufts, each of which comprises a plurality of bristle strands, having a proximal end and a free end, and is retained at its proximal end within the interior space of one of the plurality of retention rings.

13. The brush head of claim 12, wherein the interior wall of at least the first retention ring comprises a straight continuous taper extending from the first end to the second end in a direction toward the central longitudinal axis.

14. The brush head of claim 12, wherein the interior wall of at least the first retention ring comprises a straight continuous taper extending from the first end to the second end in a direction away the central longitudinal axis.

15. The brush head of claim 12, wherein the exterior wall of at least the first retention ring comprises a straight continuous taper extending from the first end to the second end in a direction toward the central longitudinal axis.

16. The brush head of claim 12, wherein the exterior wall of at least the first retention ring comprises a straight continuous taper extending from the first end to the second end in a direction away the central longitudinal axis.

17. The brush head of claim 12, wherein each of the interior wall and the exterior wall of at least the first retention ring comprises a straight continuous taper extending from the first end to the second end in a direction toward the central longitudinal axis.

18. The brush head of claim 12, wherein each of the interior wall and the exterior wall of at least the first retention ring comprises a straight continuous taper extending from the first end to the second end in a direction away the central longitudinal axis.

* * * * *